US009194128B1

(12) United States Patent
Fawley et al.

(10) Patent No.: US 9,194,128 B1
(45) Date of Patent: Nov. 24, 2015

(54) EXTERIOR MOUNTED SOLAR SHADE SCREEN FOR SKYLIGHTS

(71) Applicants: Brice Fawley, Scottsdale, AZ (US); Curtis Fawley, Carbondale, CO (US)

(72) Inventors: Brice Fawley, Scottsdale, AZ (US); Curtis Fawley, Carbondale, CO (US)

(73) Assignee: ARIZONA SKY SHADES, LLC, Scottsdale, AZ (US)

( * ) Notice: Subject to any disclaimer, the term of this patent is extended or adjusted under 35 U.S.C. 154(b) by 0 days.

(21) Appl. No.: 14/691,030

(22) Filed: Apr. 20, 2015

(51) Int. Cl.
*E04D 13/03* (2006.01)
*E06B 9/24* (2006.01)

(52) U.S. Cl.
CPC ..... *E04D 13/033* (2013.01); *E04D 13/0325* (2013.01); *E06B 9/24* (2013.01)

(58) Field of Classification Search
CPC ... E04D 13/03; E04D 13/033; E04D 13/0325; E06B 9/24; F21S 11/00
USPC ..... 52/200; 359/591
See application file for complete search history.

(56) References Cited

U.S. PATENT DOCUMENTS

| | | | | |
|---|---|---|---|---|
| 5,179,992 | A * | 1/1993 | Okarski et al. | 160/327 |
| 5,237,788 | A * | 8/1993 | Sandow | 52/200 |
| 5,568,832 | A * | 10/1996 | Eddy | 160/374 |
| 6,199,330 | B1 * | 3/2001 | Cobb | 52/202 |
| 6,209,271 | B1 * | 4/2001 | Kovacs | 52/200 |
| 6,272,800 | B1 * | 8/2001 | Phinney et al. | 52/200 |

FOREIGN PATENT DOCUMENTS

| | | | | |
|---|---|---|---|---|
| EP | 2481876 | A1 * | 8/2012 | E06B 9/024 |
| WO | WO 9516100 | A1 * | 6/1995 | E06B 9/24 |

* cited by examiner

*Primary Examiner* — Christopher Mahoney

(57) ABSTRACT

Some embodiments of the invention include an exterior mounted skylight solar shade configured to reduce solar heat gain and glare into the interior space of a building. The skylight shade may have a support skeleton including a plurality of side frame sections, arced frame sections engaging with and extending upwardly from the side frame sections, arced supports attached to the side frame sections, and a center support configured to engage with the arced frame sections and the arced supports, and a solar shade material stretched over the support skeleton. The assembly is configured to attach to a skylight frame such that the shade material is kept a distance from a skylight lens, creating an airflow passageway between the skylight lens and the solar shade material and may have a height of from about 1.5 to about 2 inches between the skylight lens and the shade material at its tallest point.

18 Claims, 4 Drawing Sheets

EXTERIOR MOUNTED SOLAR SHADE SCREEN FOR SKYLIGHTS

CROSS-REFERENCE TO RELATED APPLICATIONS

Provisional application 61/982,227. File date Apr. 21, 20014.

STATEMENT REGARDING FEDERALLY SPONSORED RESEARCH OR DEVELOPMENT

Not Applicable.

THE NAMES OF PARTIES TO A JOINT RESEARCH AGREEMENT

Not Applicable.

INCORPORATION-BY-REFERENCE OF MATERIAL SUBMITTED ON A COMPACT DISK OR AS A TEXT FILE VIA THE OFFICE ELECTRONIC FILING SYSTEM (EFS-WEB)

Not Applicable.

STATEMENT REGARDING PRIOR DISCLOSURES BY THE INVENTOR OR A JOINT INVENTOR

Prior Disclosure as part of Provisional application 61/982,227. File date Apr. 21, 2015.

BACKGROUND (1) Field of Invention

The embodiments described herein relate generally to building accessories, and more particularly, to an exterior mounted solar shade screen for skylights configured to reduce interior heat gain through solar radiation and glare.

(2) Description of Related Art

Roof mounted skylights on structures allow for a large amount of solar heat gain and sun glare into the interior living or working space. In summertime cooling climates, the additional heat gain can increase cooling energy expenses dramatically. Additionally, direct glare and hot spots from these skylights can cause eyestrain and uncomfortable living and working environments.

Some prior exterior mounted skylight solar shade screen covers are installed with direct contact between the shade and the lens or surface of the skylight, resulting in heat transfer through the lens that may occur via conduction, thus increasing temperatures on the lens of the skylight significantly. In other words, conventional products absorb sun's heat and conduct it through the skylight lens into the inside conditioned spaces of the building, reducing cooling effectiveness and efficiency. Therefore, conventional systems are not as effective and are disadvantageous because of the direct contact of the shade material and lens allows for heat transfer through conduction and also results in an increased surface temperature directly on the lens of the skylight. An unwanted byproduct of this increase in lens temperature may be a potential failure of the skylight lens. Reference U.S. Pat. No. 5,179,992, Okarski et. al.

Other prior skylight solar shade systems which do support the shade screen off the exterior lens of the skylight are commonly bulky, heavy, and quite cumbersome by nature of their design, resulting in restricted air flow and very difficult system installation and removal procedures. These bulky and heavy solar shade systems may also add undesirable loading to the skylight frame in high wind situations resulting in skylight and/or roof damage. Reference U.S. Pat. No. 6,009,929, Linderman et. al.; U.S. Pat. No. 6,014,845, Jain et. al.

Therefore, what is needed is an exterior mounted skylight solar shade screen which is lightweight and durable, easy to install and remove, and configured to effectively reduce interior heat gain through the skylight, while reducing solar glare and without increasing the surface temperature of the skylight lens.

BRIEF SUMMARY OF THE INVENTION

Some embodiments of the invention include an exterior mounted skylight solar shade configured to reduce heat gain and glare to the interior space. The skylight shade may have a support skeleton including a plurality of side frame sections, arced frame sections engaging with and extending upwardly from the side frame sections, a plurality of arced supports attached to the side frame sections, and a rigid center support configured to engage with and secure the arced supports, and a solar shade material stretched over the support skeleton. The side frame sections may be configured to attach to a skylight frame with no mechanical attachment and to interact with the arced frame such that the shade screen material is kept a distance from the skylight lens, creating a clear airflow passageway between the skylight lens and the solar shade material. In some embodiments, the airflow passageway may have a height of from about 1.5" to about 2" between the skylight lens and the solar shade material at its tallest point.

BRIEF DESCRIPTION OF THE DRAWINGS

Having thus described the invention in general terms, reference is now made to accompanying figures, which show different views of different example embodiments.

Figure 1:
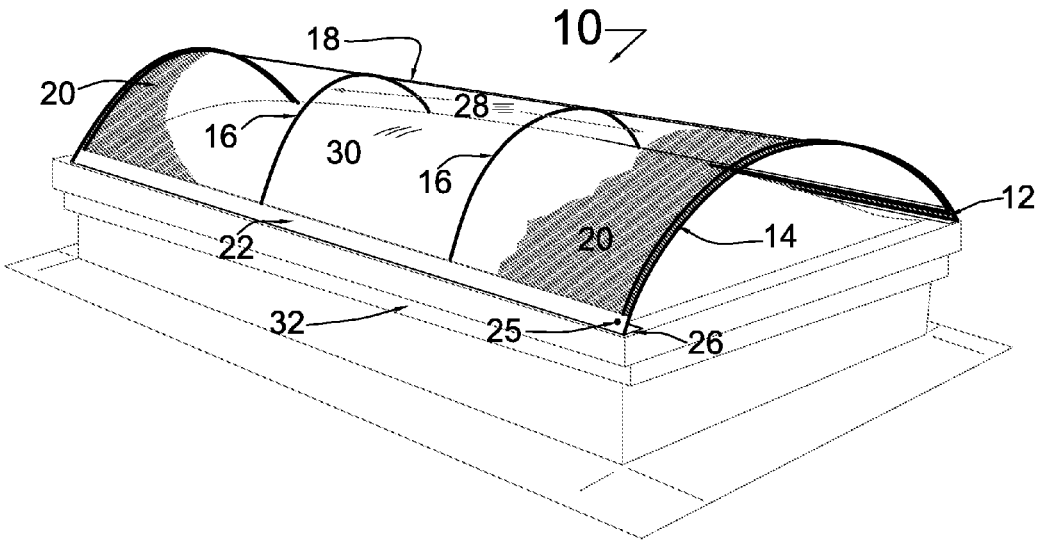

FIG. 1 shows a perspective view of the present invention covering a skylight.

Figure 2:
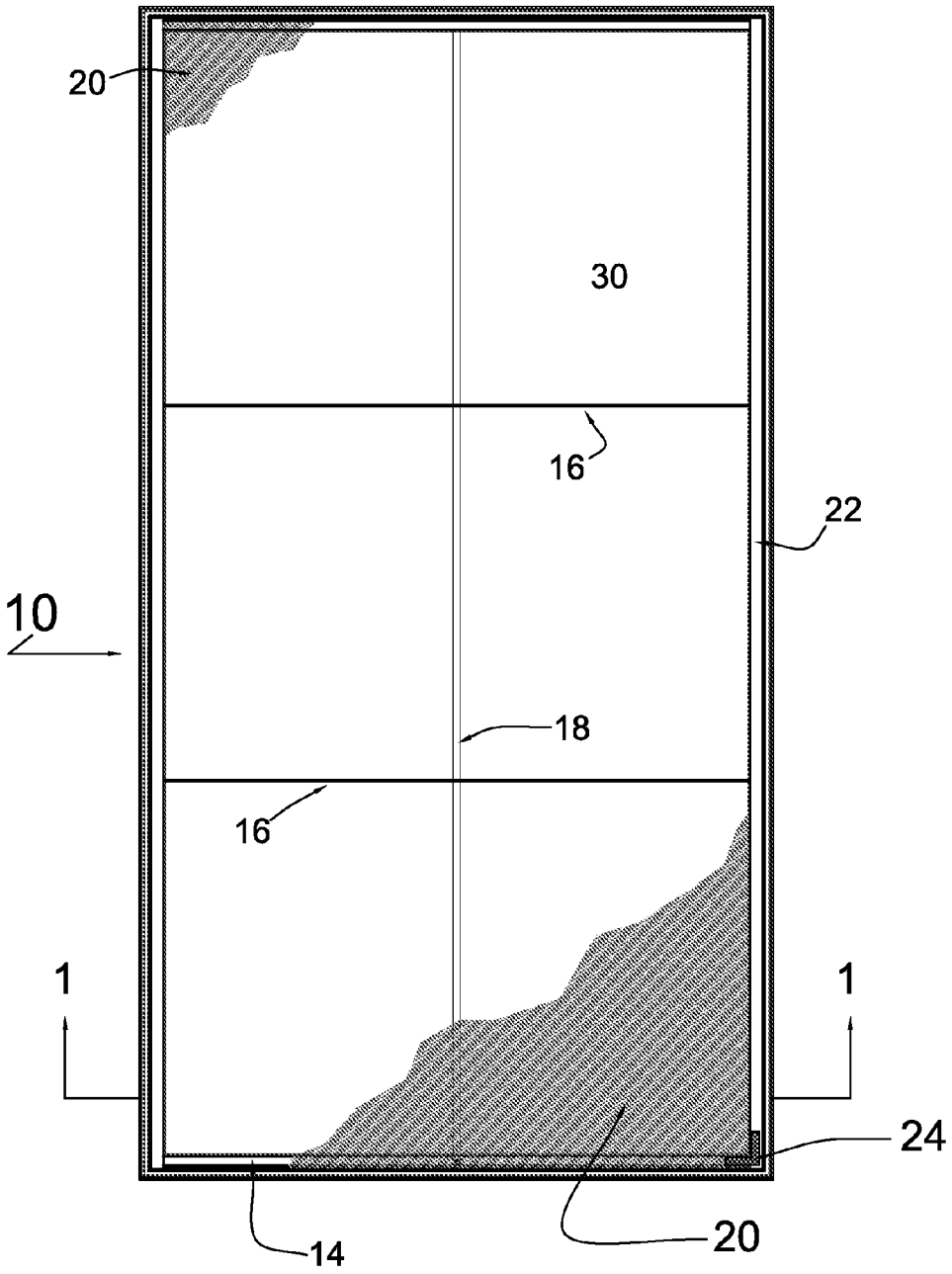

FIG. 2 shows a plan view of the present invention.

Figure 3:
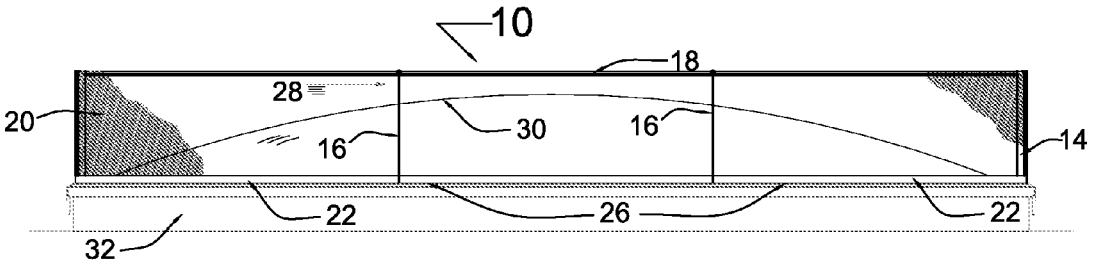

FIG. 3 shows a side view of the present invention.

Figure 4:
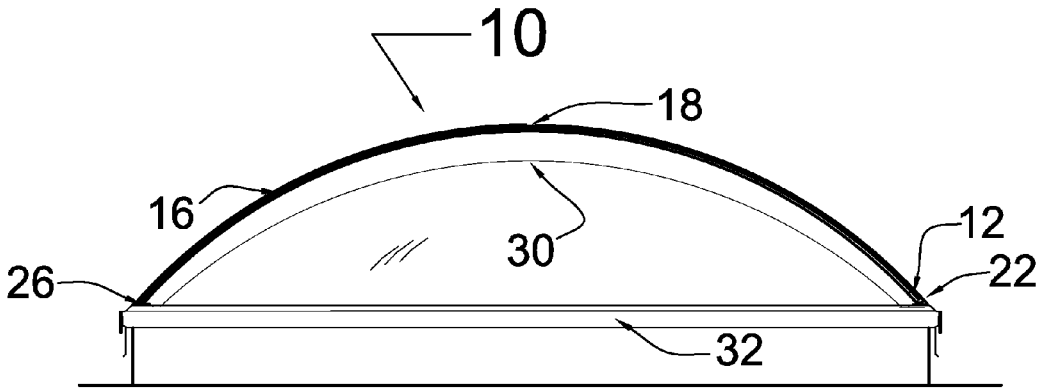

FIG. 4 shows an end sectional view of the present invention along line 1-1.

DETAILED DESCRIPTION OF THE INVENTION

In the following detailed description of the invention, numerous details, examples, and embodiments of the invention are described. However, it will be clear and apparent to one skilled in the art that the invention is not limited to the embodiments set forth and that the invention can be adapted for any of several applications.

The device of the present disclosure may be used to reduce solar heat gain from a rooftop installed skylight into the interior of a building, while also reducing interior glare and may be comprised of the following elements. This list of possible constituent elements is intended to be exemplary only, and it is not intended that this list be used to limit the system of the present application to just these elements. Persons having ordinary skill in the art relevant to the present disclosure may understand there to be equivalent elements that may be substituted within the present disclosure without changing the essential function or operation of the device.

1. Support Skeleton.
2. Solar Shade Material.
3. Airflow Passageway.

The various elements of the exterior mounted skylight solar shade configured to reduce solar heat gain and interior glare may be related in the following exemplary fashion. It is not intended to limit the scope or nature of the relationships between the various elements and the following examples are presented as illustrative examples only.

As shown FIGS. 1-4, some embodiments of the invention include a novel device for reducing solar heat gain and interior glare through a skylight, the device comprising a shading device 10 comprising a support skeleton comprising side frame sections 12, arced frame sections 14 attached to and extending upwardly from the side frame sections 12 using a corner fastener 24, arced supports 16 attached to the side frame sections 12, a rigid center support 18 configured to engage with the arced supports 16 and the arced frame sections 14, and a solar shade material 20 stretched over and secured to the support skeleton, wherein the side frame sections 12 are configured with a rigid side rail 22 to attach to a skylight frame 32 and interact with the arced frame sections 14 such that the solar shade material 20 is kept a distance from the skylight lens 30, creating an airflow passageway 28 between the skylight lens 30 and the solar shade material 20. In some embodiments, the rigid side rails 22 may be attached to the skylight frame 32 using a non-invasive fastener 26 such as an adhesive, and optionally the side frame sections 14 secured to the rigid side rail 22 using a high wind fastener 25. Each of the skeleton support pieces may be appropriately connected to the other pieces with any conventional fasteners, such as rubber, plastic, or metal connectors As shown in FIGS. 1-4, the solar shade material 20 may be tautly stretched over the support skeleton, wherein the support skeleton comprises the arced supports 16 and rigid center support 18, which may be incorporated into the structure of the skeleton both longitudinally and transversely, secured at an intersection. Thus, the shading device 10 of the present disclosure may be self supporting.

In some embodiments, the shading device 10 may have a structure resulting in an airflow passageway 28 having a height of from about 1.5 to about 2 inches between the skylight lens 30 and the solar shade material 20 at its tallest point. The airflow passageway 28 may provide proper ventilation and may reduce interior heat gain due to conduction, such as that which occurs with many conventional skylight shades.

In some embodiments, the rigid side rails 22 may be made from any suitable material. For example, in some embodiments, the rigid side rails 22 may be made from a metal material and may be adhered to a skylight frame 32 using a non-invasive fastener 26 such as an industrial double faced adhesive tape. The side frame sections 12 may be attached to, or may be configured to engage with, the arced frame sections 14, which may be made of any suitable material, such as plastic or metal. The arced frame sections 14 may be a substantially smooth curve, as shown in FIGS. 1-4.

In some embodiments, the shading device 10 may further comprise screen panels configured to attach to the open ends of the shading device 10 to completely shade the skylight for low angle sunlight, if desired.

The arced supports 16 may be made from any suitable material and, in some embodiments are fiberglass rods configured to engage with the rigid center support 18, which may be made of any suitable material, such as metal.

The solar shade material 20 may be made of any suitable solar shading material and, in some embodiments, comprises a commercially available synthetic fabric made of polyvinylchloride (PVC) coated polyester screen material.

As a result of the structure of the exterior mounted skylight solar shade of the present disclosure, the infrared heat transfer into the conditioned space of a structure may be decreased significantly by holding the solar shade material off of the skylight lens. As a result, energy requirements for cooling and unwanted glare may be considerably reduced, while still allowing for a comfortable level of ambient light to be transmitted through the shade and the lens of the skylight to the interior of a building. The shading device 10 may also be easily removed, cleaned, re-installed, and/or stored allowing for solar heat gain to occur during winter months.

Manufacturing and assembling the shade device may be a clean, easy, non-invasive process and may comprise providing solar shade material having the desired dimensions accounting for radius bend of a finished device. The arced frames may be bent to a predetermined radius specific to a particular skylight's dimensions and dome height. The side frames may be assembled with holes drilled at appropriate spans of each frame. Commercially available fiberglass rods and metal channel or t-bar may be cut to length for the support skeleton and may be placed perpendicular to each other. The rod ends may be installed into the frame at each pre-drilled hole. The solar shade material may then be stretched over the support skeleton and secured to the frame with, for example, standard rubber or PVC screen spline material. Side rails may then be affixed to the skylight frame, and the shade device assembly may be slightly compressed to facilitate installation between side rails, releasing tension after proper alignment.

The above-described embodiments of the invention are presented for purposes of illustration and not of limitation. While these embodiments of the invention have been described with reference to numerous specific details, one of ordinary skill in the art will recognize that the invention can be embodied in other specific forms without departing from the spirit of the invention. Thus, one of ordinary skill in the art would understand that the invention is not to be limited by the foregoing illustrative details, but rather is to be defined by the appended claim.

What is claimed is:

1. An exterior mounted skylight solar shade configured to reduce solar heat gain and interior glare, the skylight solar shade comprising: a support skeleton comprising:

a plurality of side frame sections; a plurality of arced frame sections engaging with and extending upwardly from the side frame sections; a plurality of arced supports attached to the side frame sections;

a rigid center support configured to engage with and secure the arced supports and arced frame sections; and a solar shade material stretched over the support skeleton such that said solar shade material defines a partial cylinder, wherein the entire solar shade assembly is configured to attach to a skylight frame with rigid side rails adhered to a skylight frame such that the solar shade material is kept a distance from a skylight lens, creating an airflow passageway between the skylight lens and the solar shade material the partial cylinder having a curved surface and a pair of parallel planar surfaces, wherein the solar shade material covers substantially only the curved portion.

2. An exterior mounted skylight solar shade as recited in claim 1 further comprising wherein the planar surfaces define an entrance and an exit for the airflow passageway.

3. An exterior mounted skylight solar shade as recited in claim 2 further comprising screen panels configured to attach to the entrance and the exit of the airflow passageway.

4. An exterior mounted skylight solar shade as recited in claim 1 wherein the support skeleton is self supporting.

5. An exterior mounted skylight solar shade as recited in claim 1, wherein the arced supports are comprised of fiberglass rods.

6. An exterior mounted skylight solar shade as recited in claim 1, wherein the shading material comprises a fabric comprising polyvinylchloride (PVC) coated polyester screen material.

7. An exterior mounted skylight solar shade as recited in claim 1, wherein the distance is in the range of from about 1.5 inches to about 2 inches.

8. An exterior mounted skylight solar shade configured to reduce solar heat gain and interior glare, the skylight solar shade comprising: a support skeleton comprising said support skeleton outlining a partial cylinder;

a plurality of side frame sections; a plurality of arced frame sections engaging with and extending upwardly from the side frame sections; a plurality of arced supports attached to the side frame sections;

a rigid center support configured to engage with and secure the arced supports and arced frame sections; and a solar shade material stretched over the support skeleton such that said solar shade material defines a partial cylinder, wherein the entire solar shade assembly is configured to attach to a skylight frame with rigid side rails adhered to a skylight frame such that the solar shade material is kept a distance from a skylight lens, creating an airflow passageway between the skylight lens and the solar shade material;

the partial cylinder having a curved portion and a pair of parallel planar portions, wherein the planar portions are not blocked by the solar shade material.

9. An exterior mounted skylight solar shade as recited in claim 8 further comprising wherein the planar surfaces define the entrance and exit for the airflow passageway.

10. An exterior mounted skylight solar shade as recited in claim 9 further comprising screen panels configured to attach to the entrance and the exit of the airflow passageway.

11. An exterior mounted skylight solar shade as recited in claim 8 wherein the support skeleton is self supporting.

12. An exterior mounted skylight solar shade as recited in claim 8, wherein the arced supports are comprised of fiberglass rods.

13. An exterior mounted skylight solar shade as recited in claim 8, wherein the shading material comprises a fabric comprising polyvinylchloride (PVC) coated polyester screen material.

14. An exterior mounted skylight solar shade as recited in claim 8, wherein the distance is in the range of from about 1.5 inches to about 2 inches.

15. A method of installing an exterior mounted skylight solar shade comprising the steps of:

providing a support skeleton, said support skeleton comprising: a plurality of side frame sections; a plurality of arced frame sections engaging with and extending upwardly from the side frame sections; a plurality of arced supports attached to the side frame sections;

a rigid center support configured to engage with and secure the arced supports and arced frame sections; and a plurality of side frame sections; a plurality of arced frame sections engaging with and extending upwardly from the side frame sections; a plurality of arced supports attached to the side frame sections;

a rigid center support configured to engage with and secure the arced supports and arced frame sections; and a solar shade material stretched over the support skeleton such that said solar shade material defines a partial cylinder, wherein the entire solar shade assembly is configured to attach to a skylight frame with rigid side rails adhered to a skylight frame such that the solar shade material is kept a distance from a skylight lens, and the solar shade material the partial cylinder having a curved surface and a pair of parallel planar surfaces, wherein the solar shade material covers substantially only the curved surface adhering rigid side rails to a skylight frame;

attaching the rigid skeleton to the side rails so as to create an airflow passageway between the skylight lens and the solar shade material.

16. A method of installing an exterior mounted skylight solar shade according to claim 15 further comprising, prior to providing the support skeleton, bending the arced frames to a predetermined radius specific to particular dimensions and dome height for a specific skylight.

17. A method of installing an exterior mounted skylight solar shade according to claim 15 further comprising adhering the side rails to the skylight frame using a non-invasive fastener.

18. A method of installing an exterior mounted skylight solar shade according to claim 17 wherein the non-invasive fastener is industrial double faced adhesive tape.

* * * * *